United States Patent [19]

McArdle et al.

[11] 4,247,984

[45] Feb. 3, 1981

[54] KNIFE AND CHOPPER BOARD COMBINATION

[75] Inventors: Christopher J. McArdle, Alta Loma; Omer T. Simeon, Playa del Rey, both of Calif.

[73] Assignee: Prodyne Enterprises, Inc., Montclair, Calif.

[21] Appl. No.: 113,596

[22] Filed: Jan. 21, 1980

[51] Int. Cl.[3] ..... B26B 27/00

[52] U.S. Cl. ..... 30/296 R; 30/115; 30/231; 83/646

[58] Field of Search ..... 30/296 R, 296 A, 231, 30/114, 115

[56] References Cited

U.S. PATENT DOCUMENTS

| | | | |
|---|---|---|---|
| 349,732 | 9/1886 | McGiven et al. | 30/115 |
| 378,004 | 2/1888 | Heaton et al. | 30/231 |
| 1,271,665 | 7/1918 | Caron | 30/296 R |
| 4,054,994 | 10/1977 | Grossman | 30/296 R |

*Primary Examiner*—Othell M. Simpson
*Assistant Examiner*—J. T. Zatarga
*Attorney, Agent, or Firm*—Keith D. Beecher

[57] ABSTRACT

A knife and chopper board combination is provided in which the knife is pivotally coupled to the board at its forward end to permit it to be turned about a vertical axis to various angular positions with respect to the top of the board and then turned about a horizontal axis for chopping, slicing or dicing food. A feature of the combination is the fact that the knife is easily removable from its supporting structure for cleaning and storing purposes.

3 Claims, 3 Drawing Figures

KNIFE AND CHOPPER BOARD COMBINATION

BACKGROUND

U.S. Pat. No. 4,054,994 illustrates and describes a fixture for attaching a knife to a breadboard at the forward end of the knife so that the knife may be pivotally swung for chopping or slicing food. In one of the embodiments disclosed in the patent, the fixture is formed of a piece of resilient sheet metal, and it includes a pair of ears extending forwardly from a body portion and provided with aligned openings which receive a vertical pivot pin. The upper end of the vertical pivot pin is provided with a yoke with aligned openings, and these openings serve to receive a horizontal pivot pin on which the forward end of the knife is pivoted. The fixture also has clamping arms which permit it to be clamped to the edge of the board.

The combination of the present invention is generally similar to the combination disclosed in the U.S. Pat. No. 4,054,994, and it is intended generally to serve the same purpose. However, the fixture of the present invention is simpler in its construction than the fixture disclosed in the patent, and the knife is supported in the fixture in a manner such that it may be readily removed from the fixture, this being achieved merely by turning the knife through 180° about a horizontal pivot pin. The fixture itself in the combination of the invention is a simple stud which extends through a hole in the chopper block and is supported on the block to be freely rotatable about a vertical axis.

A vertical slot is formed in the upper end of the stud in the combination of the present invention, and this slot receives the forward end of the knife. A pin is supported in the upper end of the stud, and it extends along a horizontal axis across the slot. The knife has a slot formed in its forward end which receives the pin, and which permits the knife to be turned about the horizontal axis of the pin to perform its chopping, slicing and/or dicing action. In addition, the knife may be turned with the stud about the vertical axis of the stud from one angular position to another on the top surface of the board. When the knife is turned through 180° about the horizontal axis of the pin, the slot in the end of the knife permits the knife to be removed from the stud for storage and/or cleaning purposes.

DETAILED DESCRIPTION OF THE ILLUSTRATED EMBODIMENT

Figure 1:
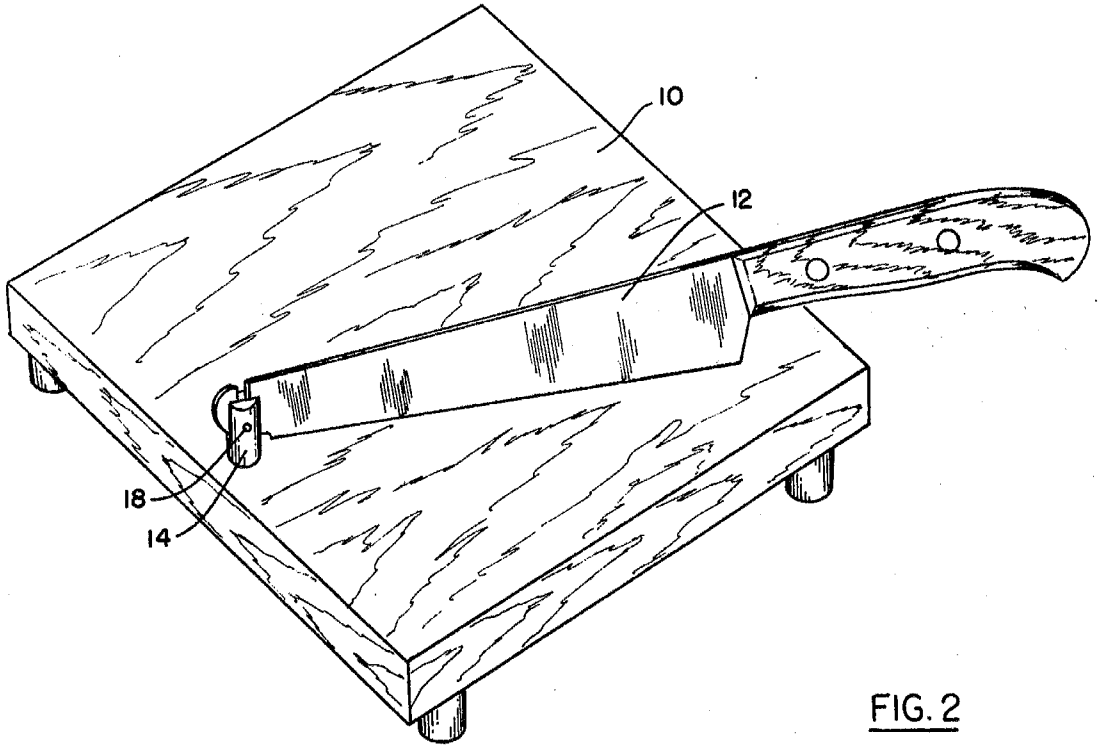
FIG. 1 is a perspective representation of one embodiment of the combination of the invention.
Figure 2:
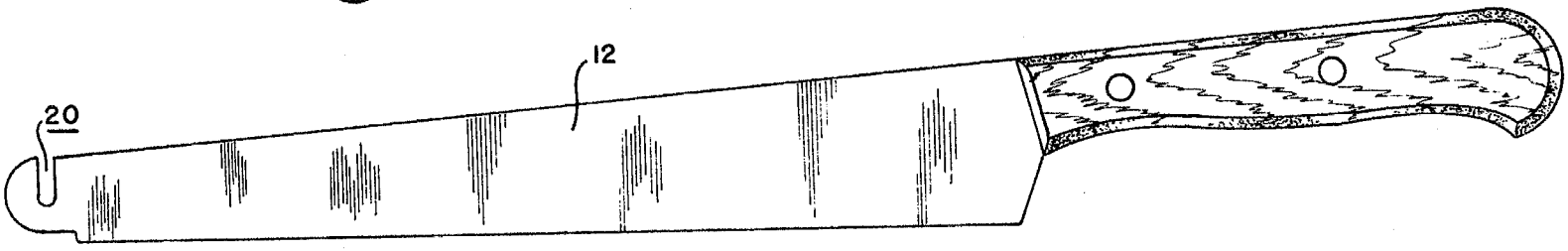
FIG. 2 is a side elevation of a knife included in the combination of FIG. 1.
Figure 3:
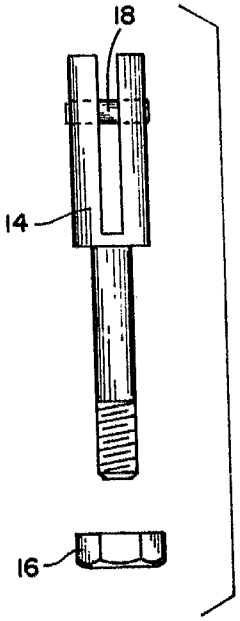
FIG. 3 is a side elevation of a stud sub-assembly which is also included in the combination.

The embodiment illustrated in FIGS. 1, 2 and 3 includes a chopping block or board 10 and a knife 12. The knife 12 is pivotally coupled to the board 10 at its forward end by a stud 14. Stud 14 extends through a hole in the board 10, and is supported in the board by a nut 16 which permits the stud to rotate freely about a vertical axis.

A vertical slot is formed in the upper end of the stud to form a yoke, and the forward end of the knife is received in the yoke.

A pin 18 is mounted in the upper end of the stud, and the pin extends across the vertical slot. The pin is received in a slot 20 at the forward end of the knife so that the knife normally is trapped in the yoke at the top of the stud.

When in position, the knife 12 may be turned, with the stud 14, about the vertical axis of the stud from one angular position on the top surface of board 10 to another. At any angular position of the knife, it may be turned about the horizontal axis of pin 18 to perform a slicing, dicing or chopping function.

The invention provides, therefore, a cutting board or chopping block with an attached freely rotatable stud into which a knife is pivotally coupled at its forward end. The knife may then be freely turned in both a horizontal and a vertical direction about the pivot point conveniently to chop, slice or dice food such as vegetables, meat, fruit, cheese, and so on. The knife, moreover, may be easily removed from the board for cleaning and safe storage.

It will be appreciated that while a particular embodiment of the invention has been shown and described, modifications may be made. It is intended in the claims to cover the modifications which come within the spirit and scope of the invention.

What is claimed is:

1. In combination: a board; a stud mounted on the board and extending upwardly from the top surface thereof, said stud having a vertical slot formed in the upper end thereof to constitute a yoke, a pin mounted in the upper end of the stud and extending transversely across the vertical slot, and a knife having an elongated blade with the forward end thereof shaped to permit the knife to be turned about the axis of the pin with the edge of the forward end engaging the inner end of the slot, and said forward end of the blade having a slot therein extending from the central longitudinal axis of the blade to the edge thereof opposite to the cutting edge at a predetermined angle to the longitudinal axis of the blade, said last-named slot extending radially from the axis of the pin when the knife is in position to permit the knife to be pivotally mounted on the pin and to be removed when the knife is turned through a vertical arc to a particular angular position about the axis of the pin.

2. The combination defined in claim 1, in which said stud is rotatably mounted in said board to permit the knife to be turned with the stud about the axis of the stud from one angular position to another on the top surface of the board.

3. The combination defined in claim 1, in which said last-named slot extends perpendicularly to the longitudinal axis of the blade.

* * * * *